US006068367A

United States Patent [19]

Fabbri

[11] Patent Number: 6,068,367

[45] **Date of Patent: *May 30, 2000**

[54] PARALLEL PRINTING DEVICE WITH MODULAR STRUCTURE AND RELATIVE PROCESS FOR THE PRODUCTION THEREOF

[75] Inventor: Franco Fabbri, Pavone, Italy

[73] Assignee: Olivetti-Lexikon, S.p.A., Ivrea, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/941,042

[22] Filed: Sep. 30, 1997

Related U.S. Application Data

[63] Continuation of application No. 08/326,850, Oct. 21, 1994, abandoned.

[30] Foreign Application Priority Data

Nov. 10, 1993 [IT] Italy ..... TO93A0852

[51] Int. Cl.[7] ..... B41J 2/155

[52] U.S. Cl. ..... 347/49

[58] Field of Search ..... 347/49, 50, 58, 347/85, 86, 87, 40

[56] References Cited

U.S. PATENT DOCUMENTS

| | | | |
|---|---|---|---|
| 3,747,120 | 7/1973 | Stemme | 347/40 |
| 4,095,237 | 6/1978 | Amberntsson et al. | 347/87 |
| 4,414,552 | 11/1983 | Bergmann et al. | 347/68 |
| 4,414,553 | 11/1983 | Perna | 347/40 |
| 4,463,359 | 7/1984 | Ayata et al. | 347/56 |
| 4,829,324 | 5/1989 | Drake et al. | 347/63 |
| 4,940,413 | 7/1990 | Cholders et al. | 347/50 |
| 4,985,710 | 1/1991 | Drake et al. | 347/63 |
| 5,016,023 | 5/1991 | Chan et al. | 347/42 |
| 5,041,190 | 8/1991 | Drake et al. | 347/65 |
| 5,057,854 | 10/1991 | Pond et al. | 347/42 |
| 5,148,194 | 9/1992 | Asai et al. | 347/49 |
| 5,160,945 | 11/1992 | Drake | 347/42 |

FOREIGN PATENT DOCUMENTS

| | | | |
|---|---|---|---|
| 0493058 | 7/1992 | European Pat. Off. | 347/87 |
| 512799 | 11/1992 | European Pat. Off. . | |

*Primary Examiner*—N. Le
*Assistant Examiner*—Anh T. N. Vo
*Attorney, Agent, or Firm*—Banner & Witcoff, Ltd.

[57] ABSTRACT

A parallel thermal ink jet printing device is produced by assembling a plurality of modules on a frame or base plate. Each of the modules is tested beforehand both from the electrical point of view and from the hydraulic point of view. In order also to allow for testing from the hydraulic point of view, each module is provided with an associated respective reservoir capable of being filled with a certain quantity of ink before the said module is assembled with the rest of the device. The reservoir preferably forms an appendix to the module capable of being inserted in a corresponding opening formed in the frame of the device so as to allow for precise alignment of the ink ejection nozzles provided on the various modules.

7 Claims, 3 Drawing Sheets

PARALLEL PRINTING DEVICE WITH MODULAR STRUCTURE AND RELATIVE PROCESS FOR THE PRODUCTION THEREOF

This application is a continuation of application Ser. No. 08/326,850, filed Oct. 21, 1994.

FIELD OF THE INVENTION

This invention relates to ink jet printing devices and more specifically to a parallel printing device (head) as defined in the pre-characterizing part of claim 1.

BACKGROUND OF THE INVENTION

The vast majority of ink jet printing devices can be reduced to two basic categories:

- devices in which a transducer (typically of the piezoelectric or similar type) produces a pressure pulse intended to effect the ejection of at least one drop of ink from a nozzle, and
- devices in which thermal energy is used to produce a vapor bubble in a channel or chamber filled with ink so as to effect the ejection of at least one drop of ink.

The present invention has been developed with particular attention to possible use in a printing device of this latter type, usually defined as a thermal ink jet printing device.

A detailed description of the basic principles of operation and of numerous possible structures of printing devices of this type is provided in the document U.S. Pat. No. 4,463,359.

Devices of this kind form the subject of rather intense patent literature, as demonstrated by way of example by the documents U.S. Pat. No. 4,985,710 and U.S. Pat. No. 5,160,945, as well as in the other patent documents cited therein.

Thermal ink jet printing devices are usually grouped in turn in two broad categories, designated "roofshooter" and "edgeshooter" respectively, as a function of the particular method for the production of the ink ejection nozzles. As will be immediately clear to the person skilled in the art, the detailed description provided hereinafter by way of example relates to a device of the "roofshooter" type. It will nevertheless be clear that the invention is not limited to such a specific construction, but can be used for the production of devices with a construction of the "edgeshooter" or other type.

Thermal ink jet printing devices are usually manufactured using semiconductor wafers and processing technology typical of the production of integrated and/or hybrid circuits. This allows, inter alia, for the production of multiple heating elements (resistors) with extremely small dimensions with associated relative control circuits (for excitation of the heating resistors) and the relative hydraulic system for supplying the ink.

This solution is ideal for the production of printing devices (heads) of small dimensions which can be associated with a cartridge containing a store of ink and can be mounted on a carriage which, during use, is moved transversely with respect to the surface to be printed, all in accordance with a typical serial printing method.

In practice, once the head has been displaced transversely with respect to the printing surface in order to print a line or strip (referred to as a "swath"), the printing surface is advanced by a corresponding amount and a transverse movement is thus imparted once again to the head in order to print another line or strip.

This same technology is also suitable, at least in principle, for the production of parallel printing devices (usually defined as the "pagewidth" type) capable of printing a line or strip in one single stroke, i.e. without requiring any scanning movement across the surface just printed.

It will be clear in this connection that the potential field of application of the printing devices in question is not limited to the traditional areas of information and office technology (printers for processing systems, typewriters, photocopiers, facsimile machines, etc.), but, above all, as a result of the fact that it can be extended to colour printers, embraces many different fields, such as the printing of textiles and decorative sheets in general. This latter field of application is very broad and promising, particularly as a result of the possibility offered by ink jet devices of avoiding the need for recourse to relatively inflexible and uneconomical traditional printing processes (with the preparation of formes, etc.) when it is desired to produce very small batches of similar products (e.g. to produce textile samples or the like).

As is well illustrated in U.S. Pat. No. 4,985,710 already mentioned hereinbefore (see in particular column 2, lines 40 to 56), the possibility of producing thermal ink jet printing devices operating with a parallel format meets with various difficulties of a technological nature, e.g.:

- the problem of producing defect-free semiconductor wafers of large dimensions in a sufficient yield to allow economical components to be obtained, and
- the risk of being faced at the end of the manufacturing process with a defective device simply as a result of the fact that a single one of the many ink ejection nozzles and of the relative heating elements (also present in several thousands in a parallel device) is not functional. These problems have hitherto been such as to render the production of devices of this kind relatively unattractive from an economical point of view.

Precisely in order to overcome this problem, it has already been proposed to assemble together several elementary modules of smaller dimensions in order to produce parallel devices. It may be useful to refer in this connection to FIG. 17 of U.S. Pat. No. 4,463,359 and to the relative description, as well as to the entire description and drawings of U.S. Pat. No. 4,985,710 and U.S. Pat. No. 5,160,945, all already mentioned hereinbefore.

However, other problems arise when adopting a modular structure, e.g. that of obtaining exact alignment of the ink ejection nozzles of the various modules, or that of ensuring that the modules assembled to form a parallel device are actually functional.

To this end, U.S. Pat. No. 5,160,945 proposes producing the parallel structure from modules (or subunits) which are defined as "fully functional". Although this concept is not defined more specifically, the description and the drawings of U.S. Pat. No. 5,160,945 relate to a structure in which a plurality of printing subunits (preferably of the roofshooter type) are mounted on the surface of one side of a structural base plate or support. A passageway is formed in the plate and, adjacent to the lateral surface containing the printing units, openings are provided between the said passageway and the ink inlets of the individual printing units mounted on the plate in such a manner that the ink supplied to the passageway in the plate is distributed to the various printing units.

Precisely as a function of this structure, the solution according to U.S. Pat. No. 5,160,945 does not completely solve the problem of the reliability of the printing device in its entirety with respect to the hydraulic supply and the ink ejection.

SUMMARY OF THE INVENTION

One aim of this invention is to provide an ink jet printing device in which the above mentioned disadvantages and/or problems are overcome in a radical manner.

The invention is defined, in its various aspects, in the appended claims to which reference should now be made.

To summarize, an embodiment of the invention provides for the production of a printing device (head) of the modular type in which each module can be completely checked (tested) before the assembly of a parallel structure both from the electrical point of view and from the hydraulic point of view, i.e. with respect to the ejection of the drops. This possibility is offered in this embodiment by virtue of the presence in each module of a respective reservoir which can be connected in a simple manner to a main reservoir which is filled with ink before the assembly of the structure. It is thus possible (according to the prior art, e.g. using testing robots) to completely test the operation of the individual module before it is inserted into the parallel structure. The above mentioned reservoir is advantageously defined by a shaped body which can be introduced under precise coupling conditions into the interior of a corresponding opening formed in the base frame of the device. The precision that can be achieved when producing openings or holes of this kind in the frame, together with the precision that can be achieved when coupling the individual module (above all when using automated visual control or adjustment) and the respective hole means that exact alignment of the ink ejection nozzles can be ensured in the final device in a simple and reliable manner.

The various modules can in fact be mounted on the frame by robot handling in the lower part of the frame and the modules can be aligned by means of visual systems with reference to the position of the array of the nozzles, the latter being fixed to the frame by means of a thermoplastic adhesive.

The degree of complete modularity achieved in this manner (even although this requirement is rendered unnecessary by the possibility of completely testing the operation of the modules before assembly and by the precision of the coupling that can be achieved) in any case allows the individual modules to be mounted on the base frame in a removable manner (e.g. by the interposition of a thermoplastic adhesive) so that any module having proven to be not fully functional once the device has been assembled, e.g. if the module is accidentally damaged during the assembly operation, can be removed and replaced.

Of course, when it is stated that each module has an associated respective ink reservoir this does not mean that each module has an associated reservoir containing a sufficient quantity of ink for the entire useful life of the printing device. In fact, in the substantially preferred embodiment of the invention, the above mentioned reservoir is defined by a cavity situated immediately behind the nozzles and is filled with a sufficient quantity of ink to test the operation of the module before assembly or, if the test takes a longer period of time (burn-in), to couple it in a simple manner to a main reservoir. In the assembled device, the reservoir of each nozzle communicates (by means of a capillarity supply system, e.g. by means of what is referred to as a nib and a spongy structure, of the well-known type) with a main reservoir or cartridge for the ink. The latter serves a certain number of modules simultaneously (e.g. all of the modules included in the device) and can be replaced periodically in a manner completely analogous to that used to replace the ink cartridges in printing devices of the known type, e.g. in serial printing devices.

BRIEF DESCRIPTION OF THE DRAWINGS

The invention will now be described purely by way of a non-limiting example with reference to the accompanying drawings, in which.

DETAILED DESCRIPTION OF PREFERRED EMBODIMENTS

It should be recalled initially that with respect to the specific technological solutions adopted for the production of the individual modules, the invention relates substantially to known prior art, as can be deduced, e.g. from the preceding patents cited in the introductory part of the description. These technological details will therefore not be described in detail in the following description as they are not relevant per se to the understanding of the solution according to the invention.

Figure 1:
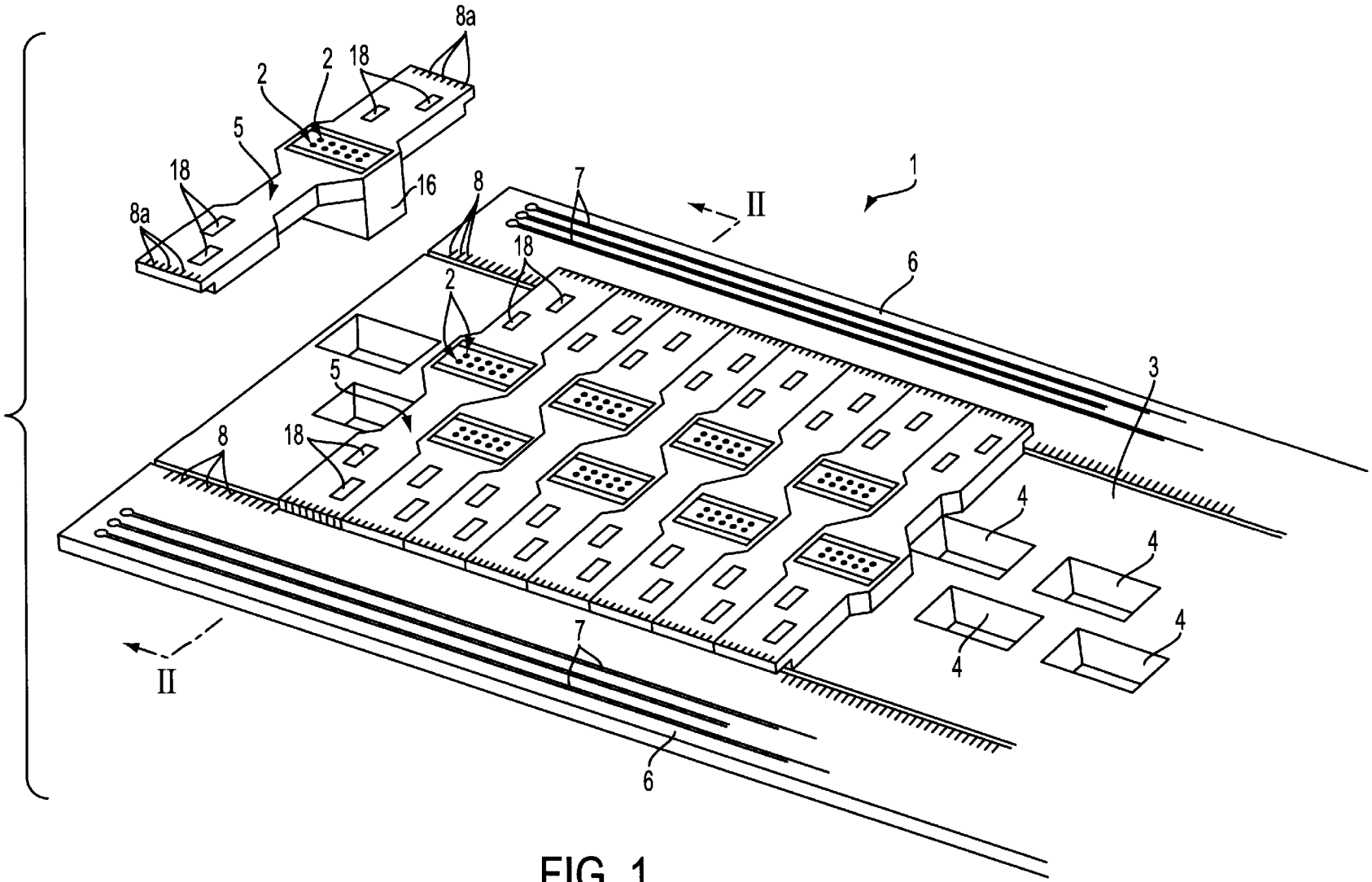
FIG. 1 is a perspective view showing part of the modular structure of a printing device embodying the invention.
Figure 2:
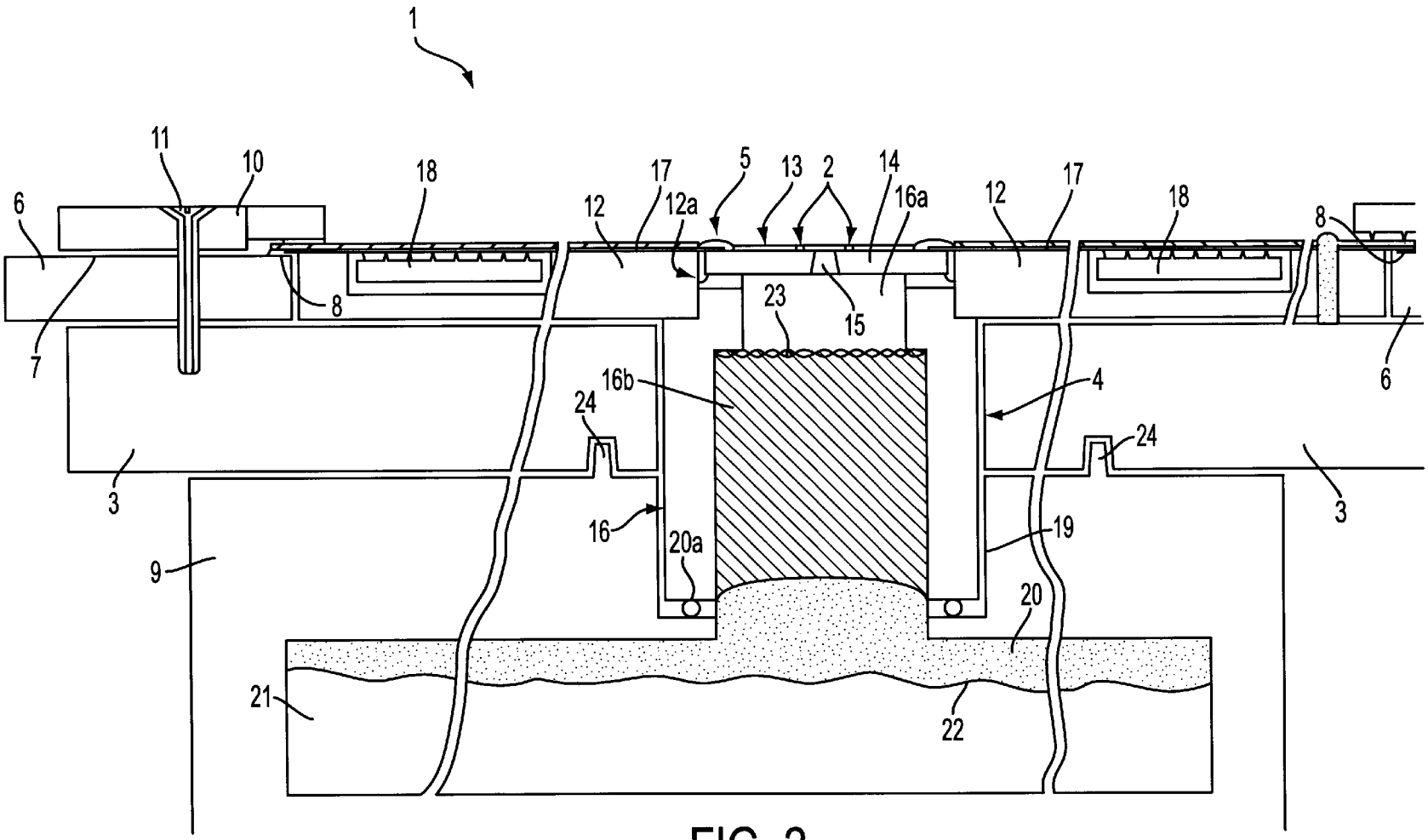
FIG. 2 is a sectional view on an enlarged scale along the line II—II of FIG. 1.

To this end, the representations of the accompanying drawings, and in particular those of FIGS. 1 and 2, represent intentionally highly schematic views in which the illustration of the specific elements characteristic of the solution embodying the invention takes preference over the representation of details well known in the art.

As already indicated in the introductory part of the description, the embodiments hereinafter relate to a device produced with a "roofshooter" type construction.

It will be clear, however, that the solution according to the invention is also suitable, with variants obvious to the person skilled in the art, for the "edgeshooter" type construction or other constructions.

In FIG. 1, the reference numeral 1 designates in general a thermal ink jet printing device (head) having a parallel structure, i.e. comprising one or more rows of nozzles 2 which, in the assembled device 1, extend in a main direction corresponding, during use, to the printing element (swath) intended to be printed simultaneously to each actuation of the device.

The device 1 is composed essentially of a base frame 3 formed by a flat plate made of a material such as aluminium in which a plurality of openings or holes 4 are formed in a precise manner in a regular array. Each opening 4 forms (in a manner illustrated more clearly hereinafter) a seat for receiving and coupling a respective module 5.

Another two lateral plates 6 forming what is referred to as PCB buses, i.e. printed circuit boards, are situated on two flanks of the base frame 3, on which distribution conductors for the signals and electrical supplies 7 are formed (according to the well-known prior art), intended to ensure by means of contact pins 8 and 8*a* that the signals for the actuation of the respective printing nozzles 2 are sent to the modules 5.

The assembly formed by the main frame 3 and by the PCB's 6 (usually semi-rigid) is then coupled (see FIG. 2) to a main reservoir (cartridge) for the ink 9. The said FIG. 2 also shows the ways in which the PCB's 6 are fixed to the frame 3, thereby forming a stabilised rigid substrate. In the example shown, the PCB's 6 are held on the frame 3 by means of plates 10 screwed at 11 on to the plate 3 and by means of an intermediate flexible element producing by pressure the electric contacts 8, 8*a* between the two printed circuits (module with bus).

As will be seen more clearly in the section of FIG. 2, each module 5 is formed by a flat plate part 12 made of plastic on which the actual printing unit 13 is mounted in correspondence with a respective opening 12*a*, said printing unit being formed by a thin sheet of gold-plated nickel or plastic (e.g. mylar) in which the nozzles 2 mounted on a silicon base plate 14 are provided. The base plate 14 is provided with a central slot or slit 15 through which the ink contained in a reservoir designated in general by the reference numeral 16 flows towards the nozzles 2. The heating elements intended to activate the mechanism for generating the bubbles and for the subsequent selective ejection of the drops of ink from the nozzles 2 are provided on the plate 14 in correspondence with each nozzle 2 (according to the prior art). These heating elements (not clearly visible in the drawings, particularly for reasons of scale) lead to a respective electrical supply network formed by metallised conductors (again not clearly visible in the drawings for reasons of scale), these leading by means of respective supply lines 17 produced with a flexible circuit (flat) to one or more electronic control units (drivers) 18.

The units 18 are usually inserted in the interior of respective cavities formed in the interior of the flat part 12 in a generally shielded position with respect to the front face of the device.

Assembly is preferably effected on the outer face in order to protect the drivers 18 from the action of any cleaning or etching agents used on the face of the plate 3.

The drivers 18 are supplied by contacts 7 provided on PCB's 6 by way of the contact pins 8, 8*a*.

The nature, number and arrangement of the units 18 can vary considerably as a function of the specific selections made.

At least in principle, it is possible to move from a solution in which no control units 18 are present on the modules 5, so that the signals for the excitation of the ink ejection are all provided from exterior by the bus 7 and the pins 8, 8*a* (i.e. a solution in which no degree of "intelligence" is present on the modules 5), to an opposing solution in which the control units 18 are formed by very sophisticated processing elements, so that only a few general functional commands arrive at each module 5 by means of the lines 7 and the pins 8, 8*a*, while the control units 18 disposed on the modules 5 provide for the processing, departing from these general commands, of the specific control signals for the active elements which control the ink ejection, and not forgetting the solution in which the control circuits of the resistors, selection and intelligence circuits are integrated into the silicon plate.

The first solution described has the advantage that the structure of each module 5 is rendered extremely simple, while the topology of the lines 7 and the contacts 8, 8*a* is rendered very complex and dense. The second solution considerably simplifies the structure of the lines 7 and the pins 8, 8*a*, thereby determining the complexity and therefore the cost of the said module as a result of the increase in the degree of sophistication of the intelligence (unit 18) associated with each module 5.

The prevailing trend is therefore for the solution to have the control units and intelligence on the head.

In any case, the solution embodying to the invention is suitable for use with either of these solutions.

In particular, the concept of the individual module 5 which is not changed if a diode matrix is integrated into the individual silicon head 13 and the control circuits (drivers 18) of the diode matrix are assembled on the flat part 12 or if the n-MOS power drivers of the array of resistors of the head are already integrated into the silicon chip 14.

As will be clearer from the sectional view of FIG. 2, the reservoir 16 associated with the module 5 is in practice formed by a cavity with shaped walls intended to be coupled with a corresponding opening 4 provided in the plate 3.

Figure 3:
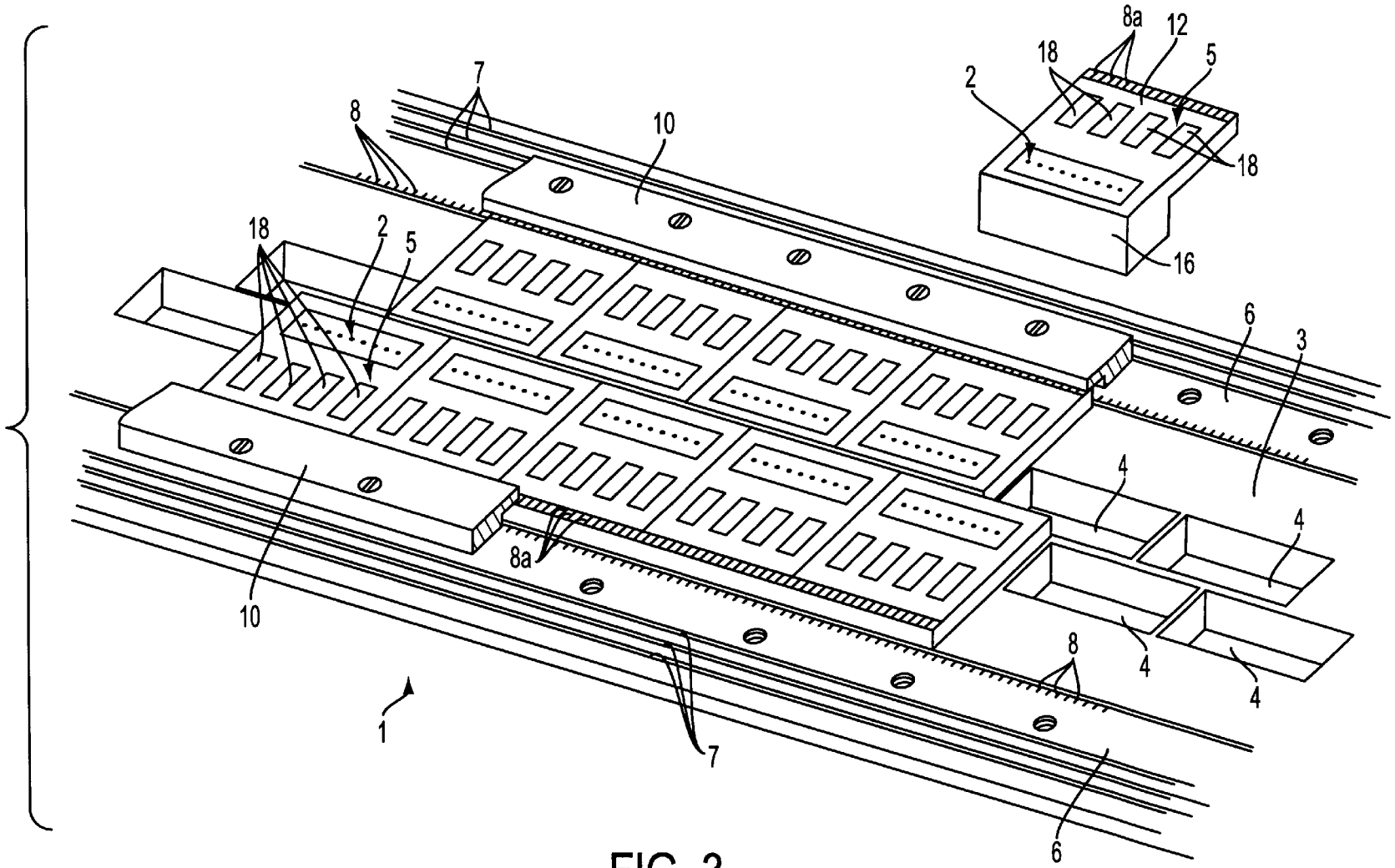
FIG. 3 shows another possible embodiment of the device according to the invention.

In both of the embodiments shown in FIGS. 1 and 3, the reservoir 16 is defined by a prismatic wall, with a substantially rectangular course complementary to the course of the openings 4. This is of course only an example. It is in fact conceivable to provide the openings 4 and correspondingly the reservoir 16 with a different shape, e.g. with a polygonal or even mixtilinear course.

The reservoir 16 usually has a substantially tubular structure with an outer end (with respect to the module 5) adjacent to the plate 14 and therefore communicating with the opening 15 for advancing the ink towards the nozzles 2, and an inner end opening towards a corresponding opening 19 provided in the walls of the main reservoir 9.

The front part of the reservoir designated in general by the reference numeral 16*a* is preferably free, while the rear part 16*b* is occupied by an absorbent wick mass (referred to as a nib) which absorbs by capillarity, thereby gradually transferring the ink contained in the interior of the main reservoir 9 to the front chamber 16*a*. To this end, the reservoir 9 usually comprises a sponge 20 situated in the front part, directed towards the module 5, in contact with the nib which is situated in the chamber 16*b*, as well as an ink refill volume 21 separated from the sponge 20 by means of a filtering system 22. An analogous filtering system 23 is firmly interposed between the nib contained in the chamber 16*b* and the front chamber 16*a* of the reservoir of each module 5.

Complementary groove and tongue formations (or similar elements) are designated by the reference numeral 24 and allow the main reservoir 9 of the device (common to several modules 5 and intended to be periodically replaced like refill cartridges) to be coupled accurately to the individual reservoirs 16 of each module 5.

The two solutions according to FIGS. 1 and 3 are identical in concept with respect to the nature of the modules 5 and the method of mounting them on the plate or frame 3.

In the case of the solution according to FIG. 1, each module 5 is formed in practice by a bar which extends transversely across the frame 3 and carries at both ends contact elements 8*a* intended to be connected to the pins 8 of the PCB's 6. According to the solution according to FIG. 1, the flat part 12 of each module 5 preferably has a mixtilinear configuration so as to allow for the coupling of the various modules 5 in an alternating sequence of modules 5 pointing in opposite directions in openings 4 provided in two opposing rows in a generally zig-zag arrangement. In this case, the reservoir 16 occupies a substantially central position within the respective module (although it is actually eccentric to allow for the alternating coupling of the various modules 5).

In the solution according to FIG. 3, on the other hand, the reservoir 16 occupies a lateral position or, preferably, an end position with respect to the corresponding module 5. In this case, the contact elements 8*a* are provided on one single side (outer side with respect to the module 5 in the final assembled arrangement).

It will be easily clear from the above how the solution embodying to the invention overcomes the problems and difficulties described in the introductory part of the description in an excellent manner.

The individual modules 5 can be produced and mounted (according to the state of the art) so that they can then be checked with respect to both their electrical properties and their hydraulic properties before they are assembled in the modular structure. The electrical operation is checked using the state of the art, using test signal configurations at the terminals 8*a* and/or other electrical terminals accessible to the device.

In order also to allow for testing from the hydraulic point of view in the reservoir 16 associated with each module and, in particular, at least in the chamber 16*a*, a certain quantity of ink is introduced. The reservoir 16 is preferably refilled in a manner known per se using vacuum-packed refilling technology.

At this point, by applying special control signals to the terminals 8*a* (and/or to the control units 18), it is possible to activate the various thermal ink ejection modules disposed in correspondence with the nozzles 2, thereby checking whether ejection is being effected correctly and possibly rejecting any modules 5 whose performance is considered unsatisfactory.

It is therefore possible to go on to mount the various modules 5 on the frame 3.

To this end, each module 5 is mounted in correspondence with the respective hole 4, thereby penetrating a respective shaped part (preferably formed by the reservoir 16 itself) in the interior of the said hole 4.

The various modules 5 are preferably assembled on the frame 3 by robot handling in the lower part of the frame 3 and alignment between the modules 5 is ensured by a visual system with reference to the position of the array of nozzles, each module 5 then being fixed to the frame 3.

The modules 5 are preferably fixed to the frame 3 by means of a thermoplastic adhesive so as to allow for the possible removal and replacement of any module which for various reasons (although it is believed there is a low probability of this being the case) is damaged and is not perfectly functional in the final device. As is stated, the possibility of testing each module 5 beforehand both with respect to its electrical properties and with respect to its hydraulic properties minimises this eventuality. Assembly of the device is completed by mounting the reservoir 9 intended to supply the respective reservoirs 16 of the various modules 5 according to the criteria described hereinbefore in correspondence with the rear face of the plate 3.

Of course, without prejudice to the principle of the invention, the features and embodiments can vary considerably from those described and illustrated, without thereby going beyond the scope of this invention.

What it is claimed is:

1. A parallel ink jet printing device comprising:

a frame a main reservoir for an ink coupled to said frame including a porous member soaked with said ink; and a plurality of modules arranged on said frame, wherein said frame is provided with a plurality of openings, and each of said modules constitutes a unit removably coupled with a corresponding opening of said frame, and wherein each of said modules comprises:

nozzles for ink ejection;

electric means for selectively controlling said ink ejection from said nozzles; and a respective reservoir provided for holding an ink refill of limited ink capacity sufficient for testing individually said module, said respective reservoir comprising shaped walls fitted with said corresponding opening of said frame, and defining a cavity partially occupied by an absorbent wick mass for holding said ink refill, said wick mass contacting said porous member of said main reservoir for allowing said ink to be transferred from said main reservoir to said respective reservoirs by capillarity for extended testing or operation of said printing device;

whereby said modules can be individually checked hydraulically and electrically before they are coupled with the openings of said frame, and moreover they can be individually removed and replaced in said openings after the assembly on said frame.

2. A device according to claim 1, wherein said ink ejection is caused by thermal generation of bubbles in said ink.

3. A device according to claim 1, wherein said main reservoir is selectively removable from said frame.

4. A device according to claim 1, in which said modules are mounted on said frame by means of a thermoplastic adhesive, whereby said modules are selectively removable from said frame.

5. A device according to claim 1, wherein said electric means for controlling ejection of ink through said nozzles are mounted on said modules.

6. A device according to claim 1, wherein each module of said plurality of modules comprises at least one respective shaped part for coupling to a respective one of said openings in said frame, whereby said ink ejection nozzles carried by said modules are aligned.

7. A device according to claim 6, wherein said respective reservoirs form at least partially said at least one respective shaped part.

* * * * *